US007469886B2

(12) United States Patent
Shen et al.

(10) Patent No.: US 7,469,886 B2
(45) Date of Patent: Dec. 30, 2008

(54) WORKING PLATFORM STRUCTURE

(76) Inventors: Yung-Tsai Shen, No. 20, Lane 704, Heping Rd., Bade City, Taoyuan County 334 (TW); Yen-Ping Shen, No. 20, Lane 704, Heping Rd., Bade City, Taoyuan County 334 (TW)

( * ) Notice: Subject to any disclaimer, the term of this patent is extended or adjusted under 35 U.S.C. 154(b) by 0 days.

(21) Appl. No.: 11/896,649

(22) Filed: Sep. 5, 2007

(65) Prior Publication Data

US 2008/0169593 A1 Jul. 17, 2008

(30) Foreign Application Priority Data

Jan. 17, 2007 (TW) ..... 96200896 U

(51) Int. Cl.
*B25B 11/00* (2006.01)

(52) U.S. Cl. ..... 269/21; 269/289 R

(58) Field of Classification Search ..... 269/21, 269/20, 289 R, 95

See application file for complete search history.

(56) References Cited

U.S. PATENT DOCUMENTS 3,453,957 A * 7/1969 Hamilton ..... 101/269
3,809,050 A * 5/1974 Chough et al. ..... 125/35
5,704,599 A * 1/1998 Slothower ..... 269/21
5,961,169 A * 10/1999 Kalenian et al. ..... 294/64.1
6,182,956 B1 * 2/2001 McMillan ..... 269/21
6,182,957 B1 * 2/2001 Becker ..... 269/21
6,540,014 B2 * 4/2003 Getchel et al. ..... 165/80.1
6,688,300 B2 * 2/2004 Tieber ..... 125/35

FOREIGN PATENT DOCUMENTS

TW 90222544 3/2005

* cited by examiner

*Primary Examiner*—Lee D Wilson
(74) *Attorney, Agent, or Firm*—Rosenberg, Klein & Lee

(57) ABSTRACT

A structure of a vacuum adsorbing working platform includes a lower body and an upper body. The lower body has a plurality of channels, and the top of the lower body has a plurality of cross grooves which extend transversely and longitudinally. The channels communicate with the grooves, and they connect to an induction pump. The upper body attached on the lower body has a plurality of ventilation holes passing through the upper body and relative to the grooves, thereby the structure of the working platform is formed which provides better suction.

13 Claims, 4 Drawing Sheets

WORKING PLATFORM STRUCTURE

BACKGROUND OF THE INVENTION

1. Field of the Invention

The present invention relates to a structure of a vacuum adsorbing working platform, and in particular to a structure of a working platform that attaches a work piece by vacuum adsorbing.

2. Description of Prior Art

A working platform is used for setting a work piece and convenient for processing. A conventional working platform that attaches the work piece by vacuum adsorbing is provided. Taiwan Patent Publication No. 522912 published on Mar. 1, 2003 discloses a vacuum adsorbing working platform having a foundation, which includes a space where a slab covers and presses the foundation. The press portion of the foundation comprises at least one channel. The channel penetrates through the foundation and connects to a joint that is attached on the foundation. Each joint connects to an induction pump. The surrounding area of the channel near the slab forms a notch that is installed with an O-ring. The O-ring is disposed a little higher than the top of the notch. The slab is formed with a top slab piled on a bottom slab. In between the top slab and the bottom slab a hole is formed. The top slab has several ventilation holes formed therein. The top surface of the bottom slab is disposed opposite to the ventilation holes coves and has several gas-guiding grooves formed thereon. The bottom slab disposed opposite to the channel of the foundation has several bores formed therein, thereby linking the channels and the gas-guiding grooves.

Although the above vacuum adsorbing working platform is provided with two gas-guiding grooves that are easily designed in the bottom slab, each of the gas-guiding grooves must be relative to the ventilation holes. Thus, it is difficult to efficiently provide the ventilation holes with a congruent vacuum effect. The different vacuum creates a negative adsorbing effect.

Furthermore, the top slab and bottom slab of the vacuum adsorbing working platform are merely attached on the foundation by four screws on each of the four corners. They can't provide enough attaching force to attach the top slab and bottom slab to the working platform securely, thereby the slab is not level and easily leaks.

Therefore, in view of this, the inventor proposes the present invention to overcome the above problems based on his expert experience and deliberate research.

SUMMARY OF THE INVENTION

The primary object of the present invention is to provide a structure of a vacuum adsorbing working platform that can offer improved vacuum. Therefore, it has better adsorbing effect.

The secondary object of the present invention is to provide a structure of a vacuum adsorbing working platform that has an improved attaching force. As a result, the working platform is maintained in a more level position and is airtight.

In order to achieve the above objects, the present invention provides a structure of a vacuum adsorbing working platform that includes a lower body having a plurality of channels; the top of the lower body has a plurality of cross grooves and the channels link to the grooves; an upper body is attached on the lower body having a plurality of ventilation holes penetrating through the upper body and is relative to the grooves.

The advantages of the present invention lie in that the inner portion of the lower body has a plurality of channels formed therein and the top of the lower body has lots of grooves crossing therein. The ventilation holes are opposite to the grooves. This design increases the suction provided by the ventilation holes by means of the channels and the grooves. Therefore, the present invention has a better adsorbing effect.

Furthermore, a plurality of locking parts are disposed and combined between the upper body and the lower body. As a result, the working platform is more level and more airtight. There is no leakage.

In order to better understand the characteristics and technical contents of the present invention, a detailed description thereof will be made with reference to the accompanying drawings. However, it should be understood that the drawings and the description are illustrative and should not be used to limit the scope of the present invention.

DETAILED DESCRIPTION OF THE INVENTION

Figure 1:
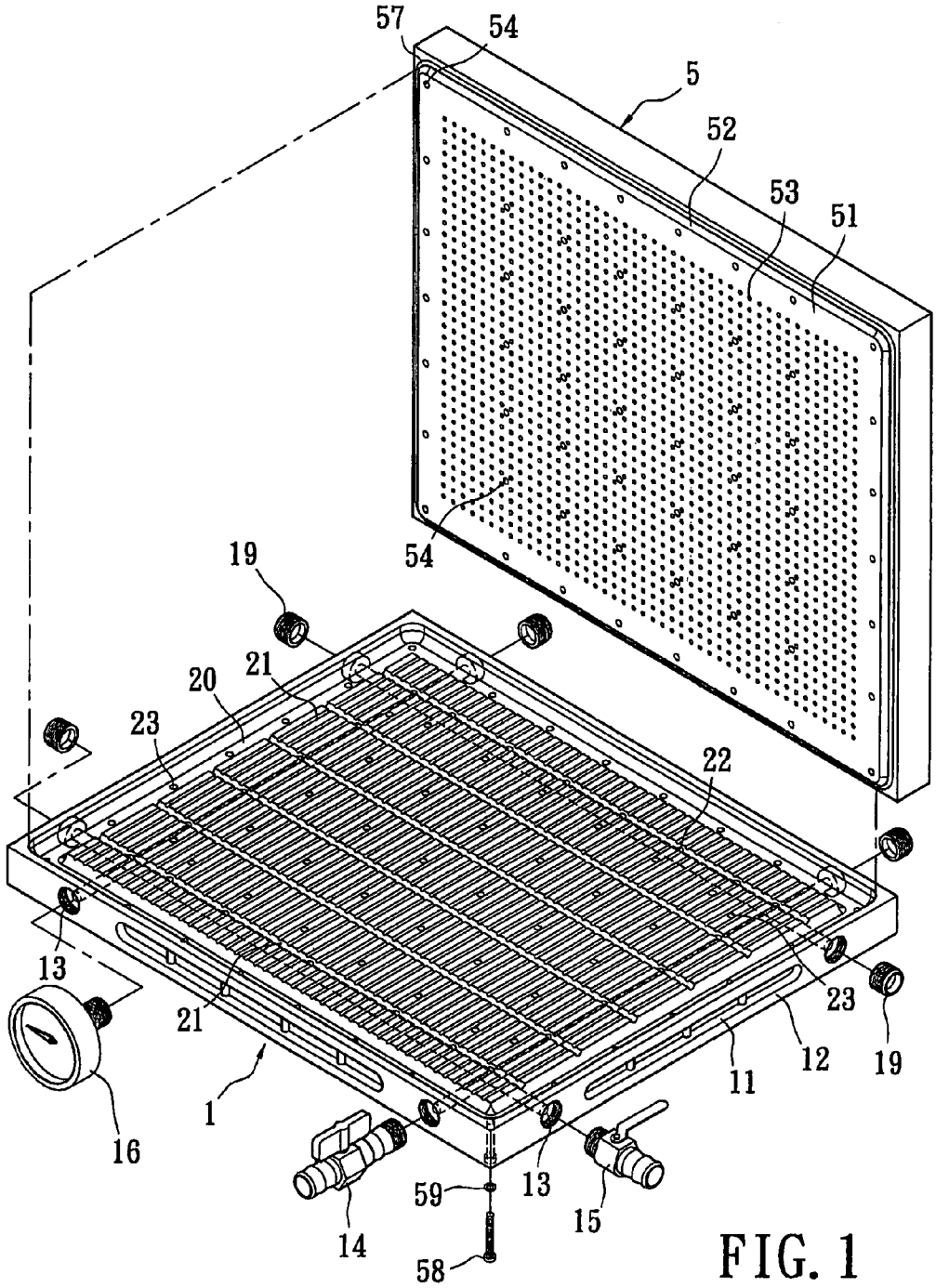
FIG. 1 is an exploded perspective view showing the structure of the work platform of the present invention.
Figure 2:
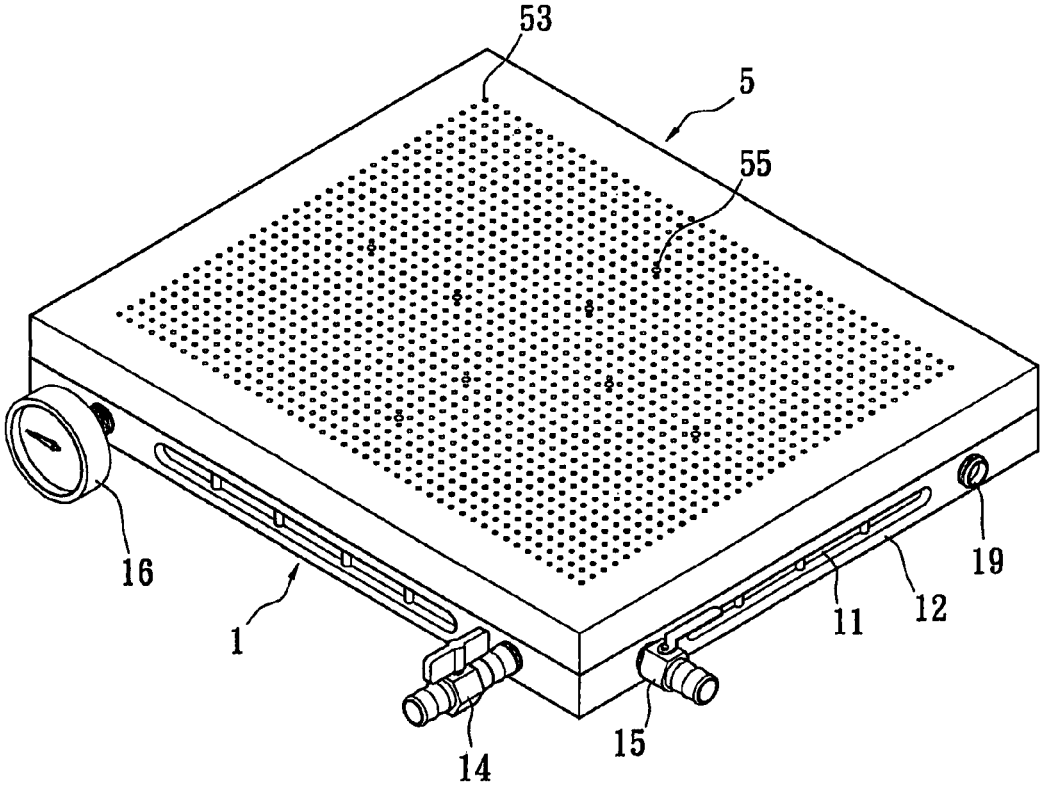
FIG. 2 is an assembled perspective view showing the structure of the work platform of the present invention.
Figure 3:
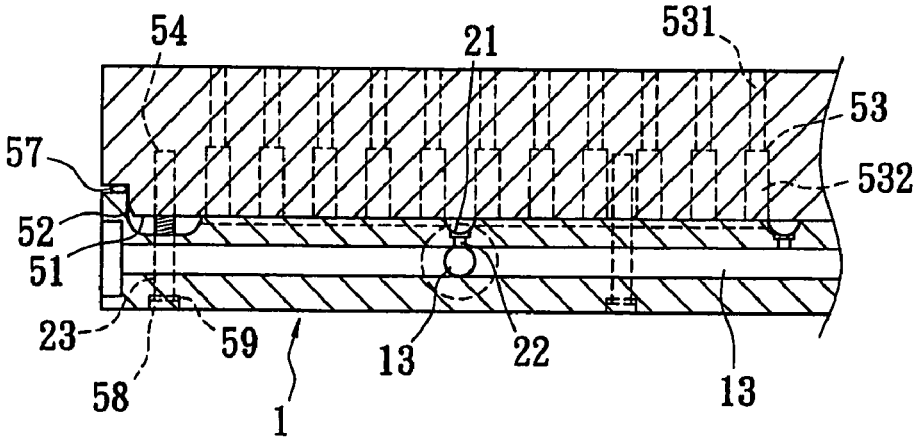
FIG. 3 is a cross-sectional view of the structure of the working platform.
Figure 4:
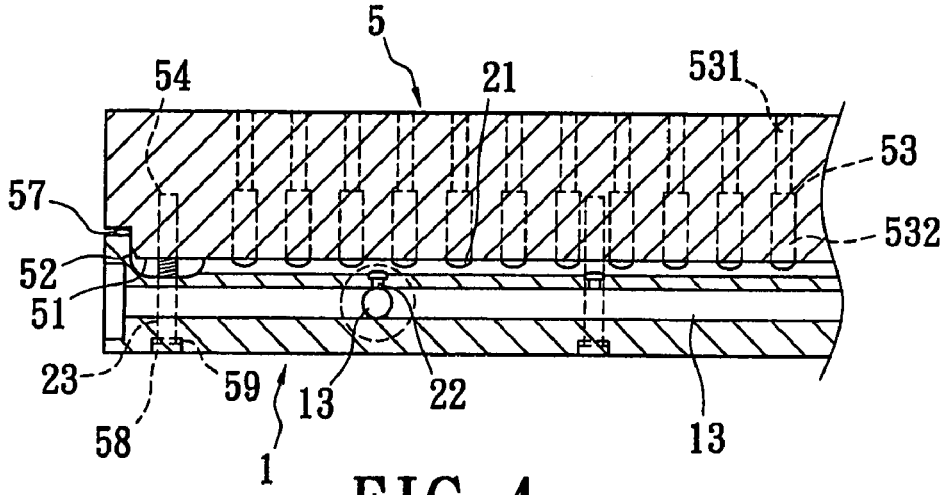
FIG. 4 is another cross-sectional view of the structure of the working platform.

Please refer to FIGS. 1 to 2, in which the present invention of a structure of a vacuum adsorbing working platform is shown. The structure of the vacuum adsorbing working platform comprises a lower body 1 and an upper body 5. The lower body 1 is made of metal materials or other similar materials and is shown as a cuboid, although it is not restricted to this shape. Each of the four sides of the lower body 1 has a slot 11 with a fixing portion 12 below. Thereby it is convenient to attach the working platform stably in an appropriate position. Further, the four sides of the lower body 1 extend outward and form four protruding parts (not shown in the Figs.), thereby it is convenient to attach the working platform stably in an appropriate position.

Please refer to FIGS. 1 and 2. The lower body 1 forms a plurality of first channels 13 that horizontally, crossing transversely and longitudinally in the lower body 1. The first channels 13 in the lower body 1 extend from one side to the opposite side. Two ends of the first channels form outlets respectively which connect a control valve 14, an air escape valve 15, and a pressure gauge 16 respectively. Further, the control valve 14 is connected with an induction pump (not shown in the Figs.). Thereby it is convenient to induct air via the induction pump for creating a vacuum in the working platform. The air escape valve 15 can be used to relieve the vacuum in the working platform. The pressure gauge 16 can be used to display the vacuum pressure in the working platform. The other outlets of the first channels 13 that are not used are closed via screwing plugs 19.

The top of the lower body 1 forms a plurality of grooves 21 that cross and extend transversely and longitudinally on a hollow area 20. Each of the grooves 21 extends from one side to the opposite side of the hollow area 20. A plurality of second channels 22 relative to the first channels 13 that extend vertically and link the grooves 21 and the first channels 13 are also provided.

The lower body 1 forms a plurality of first lock holes 23 arrayed therein. The first lock holes 23 must avoid the first channels 23, the second channels 22 or the grooves 21 in order to ensure air does not escape. The first lock holes 23 are shaped like fish eyes and extend from the top to the bottom of lower body 1.

The upper body 5, which is made of metal or other similar materials, is a cuboid or other shapes that relative to the lower body 1. The bottom of the upper body 5 forms a protruding portion 51 relative to the hollow area 20 of the lower body 1. A chamfer 52 is formed on the edge of the protruding portion 51. The upper body 5 has a plurality of ventilation holes 53 arrayed on the protruding portion 51 and relative to the grooves 21 of the top of the lower body 1. The ventilation holes 53 extend from the top of the upper body 5 to the bottom of the protruding portion 51 vertically. Each of the ventilation holes 53 comprises a small hole 531 up and a big hole 532 down.

The upper body 5 has a plurality of second lock holes 54 formed and arrayed therein. The second lock holes 54 are relative to the first lock holes 23. The second lock holes 54 are blind holes and penetrate through the bottom of the protruding portion 51 of the upper body 5.

The top of the upper body 5 has a plurality of orientation holes 55 formed with alternative orientation pins 56 (please refer to FIG. 5) which are embossed thereon. Thereby the work piece can be abut and be orientated on the top of the upper body 5 correctly.

The upper body 5 is assembled on the lower body 1 and the protruding portion 51 is tied in the hollow area 20 of the lower body 1. The chamfer 52 on the edge of the protruding portion 51 allows the protruding portion 51 to be disposed conveniently in the hollow area 20. A seal spacer 57 installed around the protruding portion 51 is provided between the upper body 5 and the lower body 1. Thereby it improves the airtight seal and avoids air leakage.

A plurality of locking parts 58, or screws, with O-rings 59 thereon combine the upper body 5 with the lower body 1 by penetrating through the first lock holes 23 of the lower body 1 and being attached in the second lock holes 54 of the upper body 5. Via the above description the present invention forms a vacuum adsorbing working platform structure.

Figure 5:
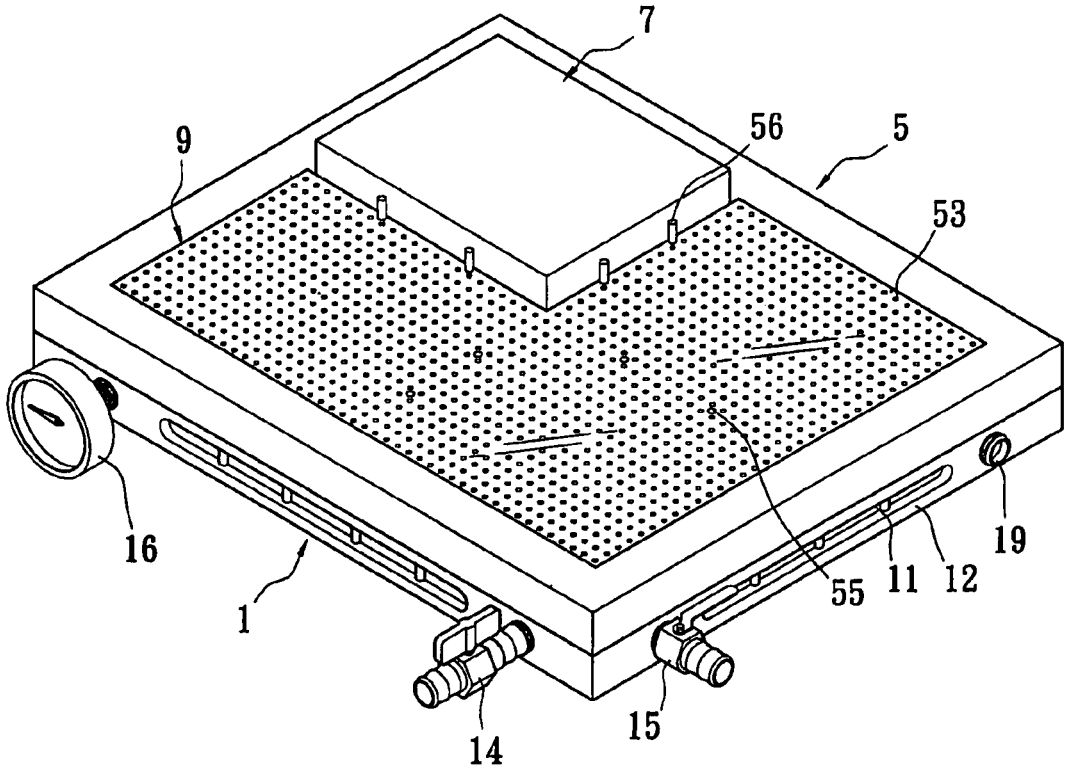
FIG. 5 is a view of the working platform in use.

Please refer to FIG. 5, which shows the present invention in a working state. The work piece 7 is disposed on the top of the upper body 5 and relative to the ventilation holes 53. We can use a film 9 to cover and close the unused ventilation holes 53. Then the induction pump is turned on to induct the air in the working platform through the first channels 13, the second channels 22, the grooves 21, and the ventilation holes 53. Thereby, it creates a vacuum that attaches the work piece 7 onto the working platform.

The advantage of the present invention lies in that:

1. The lower body 1 has the plurality of channels 13, 22 formed therein, and the top of the lower body 1 forms cross grooves 21. The ventilation holes 53 are relative to the grooves 21 on the top of the lower body 1. A better adsorbing effect and average vacuum are achieved via the guiding of the channels 13, 22 and the grooves 21.
2. The upper body 5 combines with the lower body 1 via the array locking parts 58. Thus it is secure and the fixing force is improved, As a result, the level and the airtight seal are better. There is no leakage.
3. The protruding portion 51 of the upper body 5 is tied in the hollow area 20 of the lower body 1. Thereby the airtight seal is improved and efficiently avoids leaking air. A good orientation effect is also provided.
4. The seal spacer 57 installed around the protruding portion 51 is provided between the upper body 5 and the lower body 1. Thereby it improves the airtight seal and ensures air does not leak out.
5. The plurality of locking parts 58, or screws, with O-rings 59 thereon combine the upper body 5 with the lower body 1, thereby it ensures the first lock holes 23 do not allow air to leak out.
6. The orientation pins 56 are inserted in the top of the upper body 5. Thereby the work piece can be abut and orientated on the top of the upper body 5 correctly.
7. The ventilation holes 53 use a design of big and small holes. It is convenient for clearing objects in the ventilation holes 53.

Although the present invention has been described with reference to the foregoing preferred embodiment, it will be understood that the present invention is not limited to the details thereof. Various equivalent variations and modifications may occur to those skilled in this art in view of the teachings of the present invention. Thus, all such variations and equivalent modifications are also embraced within the scope of the present invention as defined in the appended claims.

What is claimed is:

1. A working platform structure, comprising:

a lower body having a plurality of channels, the top of the lower body having a plurality of cross grooves which extend transversely and longitudinally, the plurality of channels communicating with the grooves; and an upper body attached on the lower body and having a plurality of ventilation holes extending from the top to the bottom of the upper body relative to the grooves, the upper body having a plurality of orientation holes formed with alternative orientation pins.

2. A working platform structure according to claim 1, wherein each of four sides of the lower body has a slot with a fixing portion below.

3. A working platform structure according to claim 1, wherein the channels comprise first channels and second channels, the first channels extend horizontally and crossing transversely and longitudinally in the lower body, the second channels being relative to the first channels and extending vertically and linking the grooves and the first channels.

4. A working platform structure according to claim 3, wherein the first channels in the lower body extend from one side to the opposite side, and the two ends of the first channels form outlets with plugs respectively.

5. A working platform structure according to claim 1, wherein the channels connect to a control valve.

6. A working platform structure according to claim 1, wherein the channels connect to an air escape valve.

7. A working platform structure according to claim 1, wherein the channels connect to a pressure gauge.

8. A working platform structure according to claim 1, wherein the top of the lower body forms a hollow area, the bottom of the upper body forms a protruding portion with a chamfer, and the protruding portion is tied in the hollow area.

9. A working platform structure according to claim 8, wherein the ventilation holes in the upper body extend from the top to the bottom of the upper body.

10. A working platform structure according to claim 1, wherein the ventilation holes in the upper body are comprised of small holes up and big holes down.

11. A working platform structure according to claim 1, wherein the lower body has a plurality of first lock holes formed and arrayed therein, the upper body has a plurality of second lock holes formed opposite to the first lock holes, and a plurality of locking parts with O-rings thereon combine the upper body with the lower body by penetrating through the first lock holes and being attached in the second lock holes.

12. A working platform structure according to claim 1, wherein the ventilation holes are arrayed in the upper body.

13. A working platform structure according to claim 1, wherein a seal spacer is provided between the upper body and the lower body.

* * * * *